United States Patent [19]

Belvederi et al.

[11] Patent Number: 5,033,482

[45] Date of Patent: Jul. 23, 1991

[54] METHOD OF MANUFACTURING FILTER-TIPPED CIGARETTES

[75] Inventors: Bruno Belvederi, S. Martino di Monte S. Pietro; Salvatore Rizzoli, Bologna, both of Italy

[73] Assignee: G. D Societa per Azioni, Bologna, Italy

[21] Appl. No.: 646,275

[22] Filed: Jan. 28, 1991

[30] Foreign Application Priority Data

Feb. 8, 1990 [IT] Italy ..... 3333 A/90

[51] Int. Cl.[5] ..... A24C 5/47; A24C 5/52

[52] U.S. Cl. ..... 131/94

[58] Field of Search ..... 131/94

[56] References Cited

U.S. PATENT DOCUMENTS 2,898,998 8/1959 Schur ..... 131/94

3,363,632 1/1968 Gamberini ..... 131/94

FOREIGN PATENT DOCUMENTS 959345 5/1964 United Kingdom ..... 131/94

*Primary Examiner*—V. Millin

*Assistant Examiner*—J. L. Doyle

*Attorney, Agent, or Firm*—Marshall, O'Toole, Gerstein, Murray & Bicknell

[57] ABSTRACT

A method of manufacturing filter-tipped cigarettes whereby series of first and second double cigarette portions, produced by transversely cutting two continuous cigarette rods traveling axially at substantially constant speed, are fed by respective transfer members into respective seats on respective first and second receiving rollers.

The first double portions are then fed into respective seats on a third transfer roller and subsequently into alternate seats on a fourth transfer roller, the vacant seats of which receive the second double portions supplied by the second transfer roller. The first and second double portions on the fourth transfer roller are cut transversely to produce, on the fourth roller, successive pairs of aligned single portions, which are parted axially, connected via the interposition of a double filter, and then cut into cigarettes by cutting the double filter.

3 Claims, 2 Drawing Sheets

METHOD OF MANUFACTURING FILTER-TIPPED CIGARETTES

BACKGROUND OF THE INVENTION

The present invention relates to a method of manufacturing filter-tipped cigarettes.

In particular, the present invention relates to a method of manufacturing filter-tipped cigarettes using a filter assembly machine and commencing from a dual-rod cigarette manufacturing machine of the type described and claimed, for example, in U.S. Pat. No. 4,418,705, which provides for feeding the filter assembly machine with two continuous cigarette rods traveling axially at substantially constant speed.

On leaving the manufacturing machine, the two continuous cigarette rods are fed through the same cutting head, usually a rotary type, by which they are normally cut into "double portions", i.e. portions twice the length of that which, when joined to the filter, goes to form a normal filter-tipped cigarette. Still traveling axially and pushed from behind by the respective continuous cigarette rods, the double portions are fed to a pickup station where a transfer member simultaneously picks up a pair of double portions, one from each rod, and feeds them inside successive seats on a common roller feeding the filter assembly machine.

As described and illustrated, for example, in U.S. Pat. No. 4,577,644, a filter assembly machine usually comprises a series of parallel feed rollers, each having a number of peripheral seats for receiving a respective double portion and feeding it forward transversely in relation to its longitudinal axis, i.e. perpendicularly to the traveling direction of the double portion as it leaves the manufacturing machine.

Due to the double portions being supplied in pairs to the filter assembly machine along a 90° route, the transfer member, e.g. of the type described in U.S. Pat. No. 4,645,063, must be designed not only to enable a 90° switch in the traveling direction of the double portions, but also to ensure both double portions are fed simultaneously into consecutive seats on the input roller of the filter assembly machine.

Though perfectly efficient, operation of said transfer member, especially as regards simultaneous input of both double portions, is so complex as to be substantially unfeasible at higher than current operating speeds, thus ruling out any possibility of increasing the operating speed of current manufacturing machinery.

SUMMARY OF THE INVENTION

The aim of the present invention is to provide a method of manufacturing filter-tipped cigarettes commencing from a dual-rod cigarette manufacturing machine, designed to overcome the aforementioned drawback.

With this aim in view, according to the present invention, there is provided a method of manufacturing filter-tipped cigarettes commencing from a dual-rod cigarette manufacturing machine, said method comprising stages consisting in:

obtaining series of first and second double cigarette portions by transversely cutting respective first and second continuous cigarette rods produced on said manufacturing machine and traveling axially at substantially constant speed;

feeding said first and second double portions into respective longitudinal seats on the same receiving roller and in such a manner that they are aligned transversely with one another;

cutting said double portions transversely in half to produce pairs of aligned single portions;

connecting each said pair of single portions via the interposition of a double filter; and cutting said double filters to produce single filter-tipped cigarettes;

characterised by the fact that said first and second double portions are transformed to said receiving roller by a first and second transfer member assigned respectively to said first and said second rod; each said transfer member feeding respective said portions successively and one by one into alternate seats on said receiving roller.

Preferably, said first transfer member successively transfers said first double portions into respective equally spaced seats on a first intermediate roller cooperating with said receiving roller via the interposition of a third intermediate roller tangent to both said first intermediate roller and said receiving roller; said third intermediate roller rotating the opposite way to said receiving roller and said first intermediate roller, and presenting seats for said first double portions, the spacing of which seats is the same as on said first intermediate roller and twice that of said receiving roller.

Preferably, said second transfer member successively transfers said second double portions into respective equally spaced seats on a second intermediate roller tangent to and rotating the opposite way to said receiving roller; the seat spacing of said second intermediate roller being twice that of said receiving roller.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
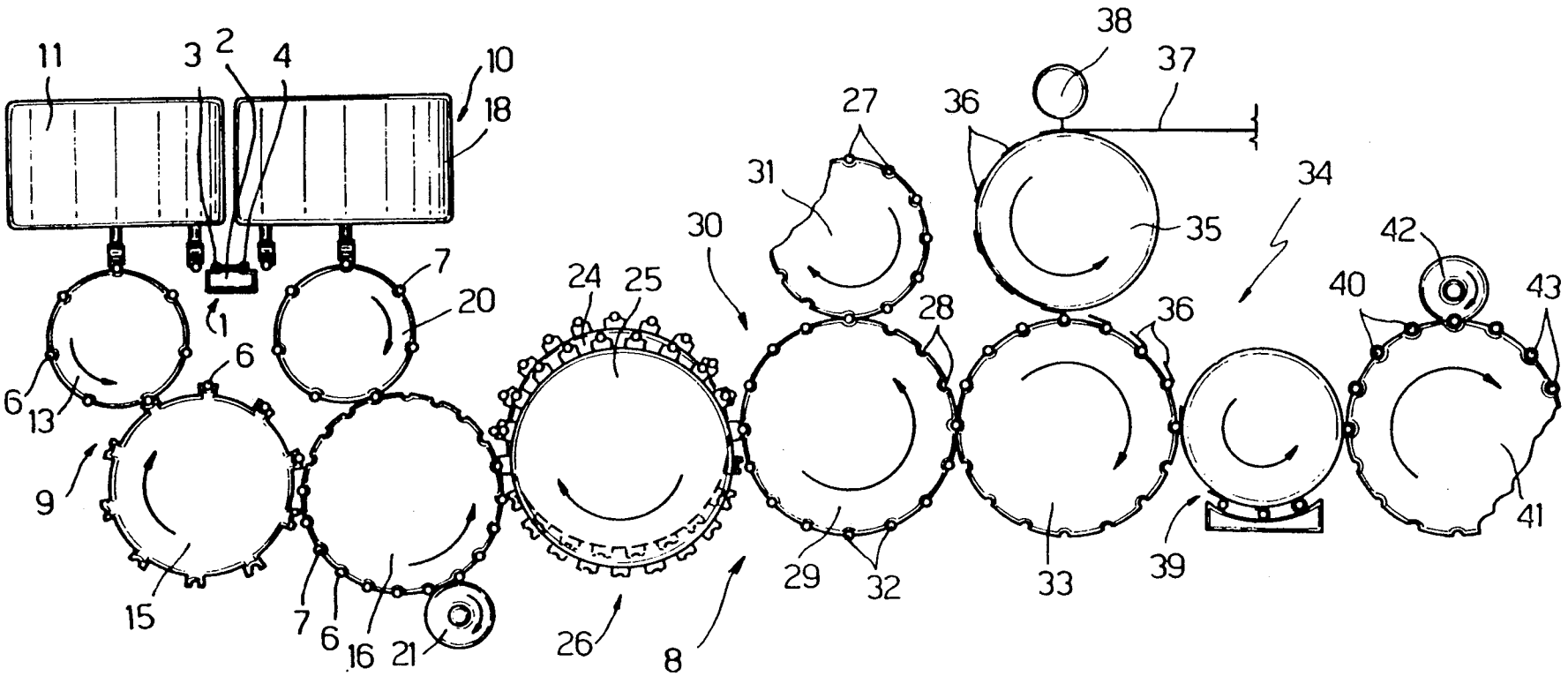
FIG. 1 shows a schematic view of part of a filter assembly machine connected to a dual-rod cigarette manufacturing machine and implementing the method according to the present invention.

Number 1 in FIG.S 2 and 3 indicates a dual-rod cigarette manufacturing machine of the type described and illustrates in U.S. Pat. No. 4,418,705, the content of which is fully incorporated herein in the interest of full disclosure.

Machine 1 comprises an output plate 2 along which two continuous cigarette rods 3 and 4 are fed at the same substantially constant axial speed, and cut by a known rotary cutting head 5 into respective portions 6 and 7. Cutting head 5 is operated at such a speed as to produce portions 6 and 7 twice as long as the tobacco-filled portion of the filter-tipped cigarettes being produced. Number 8 in FIG. 1 indicates a filter assembly machine having an input unit 9 connected to output plate 2 of machine 1 via a transfer unit indicated as a whole by 10 and designed to successively transfer portions 6 and 7 from plate 2 to machine 8.

Figure 3:
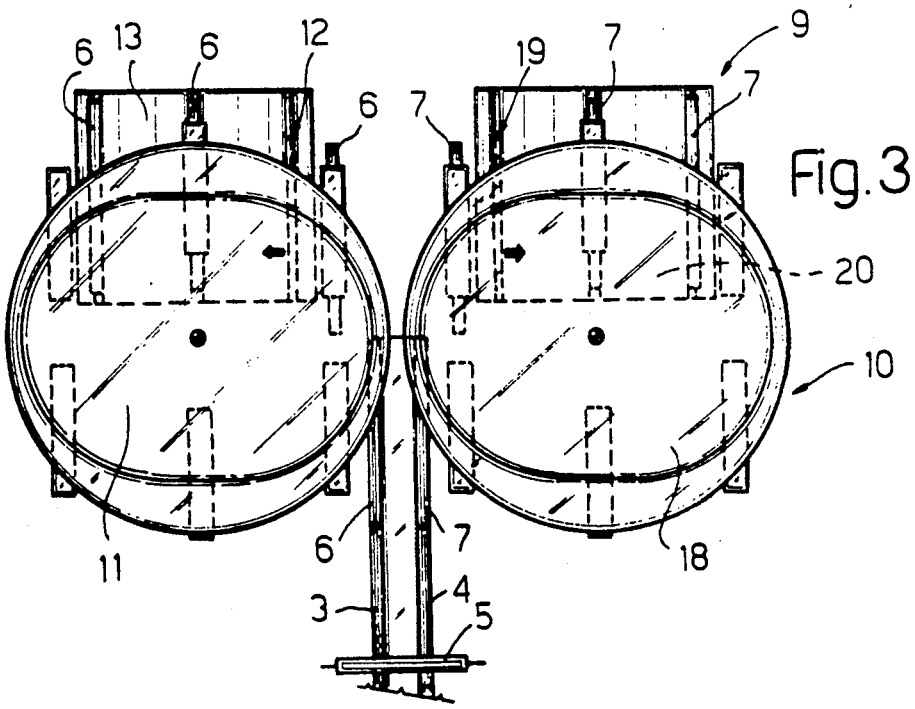
FIG. 3 shows a plan view of a detail in FIG.S 1 and 2.

As shown in FIG. 3, plate 2 terminates beneath a first known rotary pickup unit 11 forming part of transfer unit 10 and of the type described, for example, in U.S. Pat. No. 3,303,926.

As it turns (anticlockwise to FIG. 3) about its axis, preferably perpendicular to plate 2, unit 11 successively transfers portions 6 into respective peripheral seats 12 on a first intermediate roller 13 forming part of input unit 9 and powered so as to turn (anticlockwise in FIG. 1) at constant speed about its axis parallel to plate 2. As it turns about its axis, roller 13 feeds portions 6 forward, transversely in relation to their longitudinal axis, and successively transfers them into respective peripheral seats 14 on a second intermediate roller 15 forming part of input unit 9 and powered so as to turn about its axis in the opposite direction to and at the same speed as roller 13.

Figure 2:
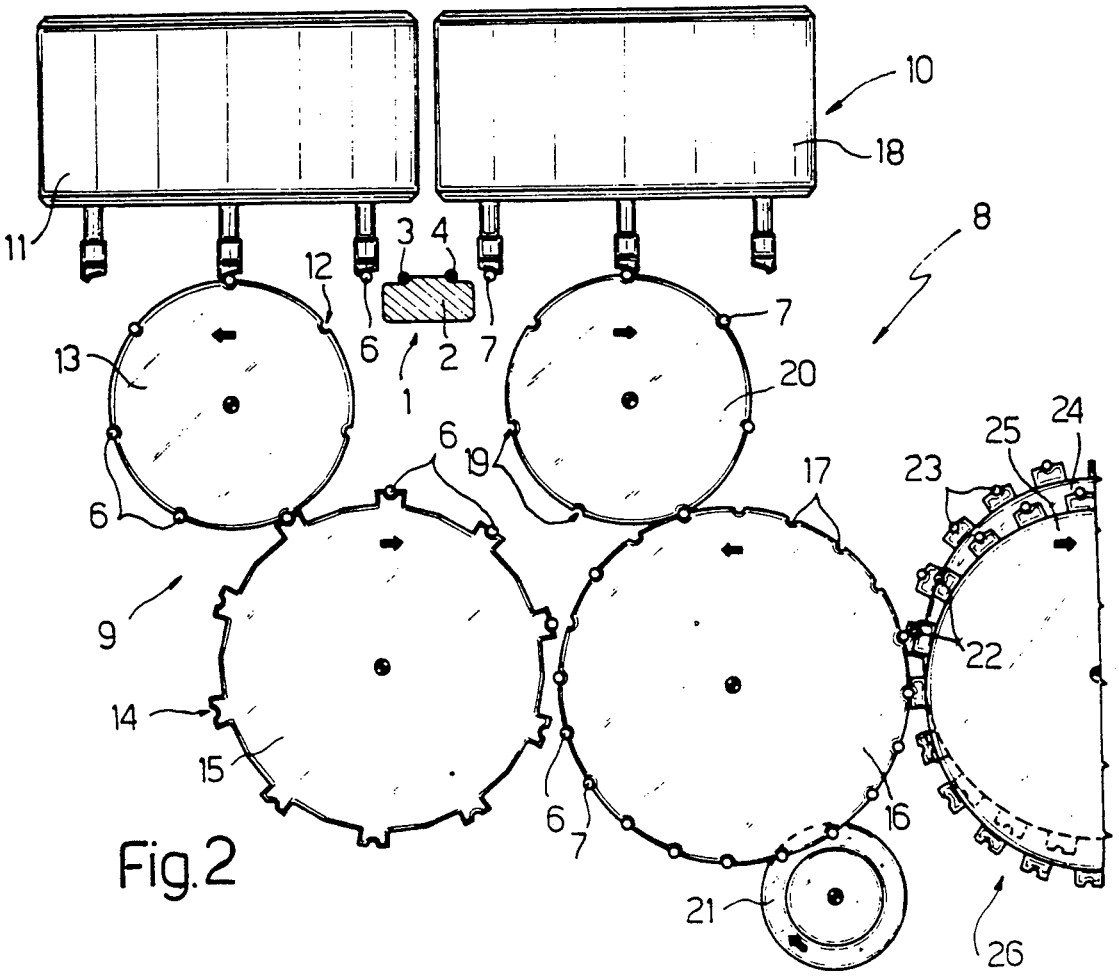
FIG. 2 shows a larger-scale view of a detail in FIG. 1.

As shown, particularly in FIG. 2, rollers 13 and 15 are parallel and substantially tangent to each other, and seats 14 on roller 15 present the same spacing as seats 12. Roller 15 is also tangent to the outer edge of an input roller 16 of machine 8, which roller 16 constitutes the final output roller of input unit 9, and is powered so as to turn about its axis, parallel to plate 2, in the same direction as roller 13.

Roller 16 presents equally spaced peripheral seats 17, the spacing of which is half that of seats 14 on roller 15. Thus, by means of roller 15, portions 6 are transferred successively from seats 12 on roller 13 to alternate seats 17 on roller 16.

As shown, particularly in FIG. 2, transfer unit 10 comprises a second rotary pickup unit 18 identical to and located beside unit 11, over the end of plate 2. As it turns (clockwise in FIG. 3) about its axis, preferably perpendicular to plate 2, unit 18 successively transfers portions 7 into respective peripheral seats 19 on a third intermediate roller 20 forming part of input unit 9 and powered so as to turn (clockwise in FIG. 1) at constant speed about its axis parallel to plate 2. Peripheral seats 19 on roller 20 present the same spacing as seats 14 on roller 15. Roller 20 is arranged tangent to roller 16 and, as it turns about its axis, feeds portions 7 forward, transversely to their longitudinal axis, and successively transfers them into respective alternate seats 17 on roller 16 left vacant by portions 6.

In other words, seats 17 are all eventually occupied by respective transversely aligned double portions 6 or 7, which are fed transversely on roller 16 through a cutting unit 21 by which each double portion 6 and 7 is cut into two single portions 22 and 23 aligned axially inside the same seat 17.

As shown in FIG. 1, roller 16 is arranged tangent to two side by side rollers 24 and 25 of an axial parting or spacing unit indicated as a whole by 26 and of the type described in U.S. Pat. No. 4,531,629, the content of which is fully incorporated herein in the interest of full disclosure.

By virtue of unit 26, rollers 24 and 25 of which are offset vertically and mounted so as to turn about respective axes at an angle to each other, portions 22 and 23 aligned inside the same seat 17 are parted axially by a distance substantially equal to the length of a double filter 27, and fed into the same seat 28 on a roller 29 substantially tangent to rollers 24 and 25 and turning about its axis in the same direction as roller 16 and at the same speed as rollers 24 and 25.

Roller 29 is parallel to roller 16, and forms part of a known assembly unit 30, which also comprises a roller 31 for supplying double filters 27. As shown in FIG. 1, roller 31 is substantially tangent to roller 29 and, turning about its axis in the opposite direction to and at the same speed as roller 29, provides for feeding a double filter 27 into the central portion of each seat 28 corresponding to the gap between the facing ends of each two portions 22 and 23. When fed into respective seat 28, each double filter 27 thus defines, inside seat 28, two vacant end portions, which are eventually filled by respective portions 22 and 23 fed off unit 26, so as to produce, on roller 29, a group 32 consisting of two coaxial portions 22 and 23 separated by a double filter 27.

Groups 32 are fed successively by roller 29 on to the input roller 33 of a finishing unit 34 of the type described and claimed in Italian Patent N. 1,200,229, the content of which is fully incorporated herein in the interest of full disclosure.

As shown in FIG. 1, in addition to roller 33, unit 34 also comprises a roller 35 for feeding strips 36 cut off a continuous strip 37 by a cutting unit 38, and each used for joining portions 22 and 23 and double filter 27 of each group 32. Unit 34 also comprises a rolling unit 39 for successively receiving groups 32 and respective strips 36 off roller 33; rolling each strip 36 about respective double filter 27 and the facing ends of respective portions 22 and 23, to produce a double cigarette 40; and successively feeding said double cigarettes 40 on to an output roller 41. On roller 41, double cigarettes 40 are fed through a cutting unit 42 by which double filters 27, and consequently double cigarettes 40, are cut in half to produce coaxial pairs of cigarettes 43, which are fed by roller 41 on to further units (not shown) of filter assembly machine 8.

I claim:

1. A method of manufacturing filter-tipped cigarettes (43) commencing from a dual-rod cigarette manufacturing machine (1), said method comprising stages consisting in:

obtaining series of first (6) and second (7) double cigarette portions by transversely cutting respective first (3) and second (4) continuous cigarette rods produced on said manufacturing machine (1) and traveling axially at substantially constant speed;

feeding said first and second double portions (6, 7) into respective longitudinal seats (17) on the same receiving roller (16) and in such a manner that they are aligned transversely with one another;

cutting said double portions (6, 7) transversely in half to produce pairs of aligned single portions (22, 23); connecting each said pair of single portions (22, 23) via the interposition of a double filter (27); and cutting said double filters (27) to produce single filter-tipped cigarettes (43);

characterised by the fact that said first and second double portions (6, 7) are transferred to said receiving roller (16) by a first (11) and second (18) transfer member assigned respectively to said first (3) and said second (4) rod; each said transfer member (11, 18) feeding respective said portions (6, 7) successively and one by one into alternate seats (17) on said receiving roller (16).

2. A method as claimed in claim 1, characterised by the fact that said first transfer member (11) successively transfers said first double portions (6) into respective equally spaced seats (12) on a first intermediate roller (13) cooperating with said receiving roller (16) via the interposition of a third intermediate roller (15) tangent to both said first intermediate roller (13) and said receiving roller (16); said third intermediate roller (15) turning the opposite way to said receiving roller (16) and said first intermediate roller (13), and having seats (14) for said first double portions (6), the spacing of which seats (14) is the same as the seats (12) on said first intermediate roller (13) and twice that of the seats (17) on said receiving roller (16).

3. A method as claimed in claim 1, characterised by the fact that said second transfer member (18) successively transfers said second double portions (7) into respective equally spaced seats (19) on a second intermediate roller (20) tangent to and turning the opposite way to said receiving roller (16); the spacing of said seats (19) on said second intermediate roller (20) being twice that of the seats (17) on said receiving roller (16).

* * * * *